United States Patent [19]

Arita

[11] 4,118,304

[45] Oct. 3, 1978

[54] ELECTROLYTIC ALUMINA REDUCTION CELL WITH HEAT RADIATION REDUCING MEANS

[75] Inventor: Youji Arita, Yokohhama, Japan

[73] Assignee: Mitsubishi Light Metal Industries Limited, Tokyo, Japan

[21] Appl. No.: 825,070

[22] Filed: Aug. 16, 1977

[30] Foreign Application Priority Data

Sep. 7, 1976 [JP] Japan ..... 51-107012

[51] Int. Cl.[2] ..... C25C 3/08

[52] U.S. Cl. ..... 204/243 R; 204/245

[58] Field of Search ..... 204/243 R, 247, 67, 204/244–246

[56] References Cited

U.S. PATENT DOCUMENTS

| | | | |
|---|---|---|---|
| 3,256,173 | 6/1966 | Schmitt et al. | 204/243 R |
| 3,960,696 | 6/1976 | Wittner et al. | 204/243 R X |
| 4,052,288 | 10/1977 | Sala | 204/244 X |

FOREIGN PATENT DOCUMENTS

| | | | |
|---|---|---|---|
| 248,239 | 12/1969 | U.S.S.R. | 204/243 R |
| 378,515 | 7/1973 | U.S.S.R. | 204/243 R |

*Primary Examiner*—Howard S. Williams
*Assistant Examiner*—D. R. Valentine
*Attorney, Agent, or Firm*—Oblon, Fisher, Spivak, McClelland & Maier

[57] ABSTRACT

In an electrolytic alumina reduction cell having a cathode formed by carbon blocks at the bottom and a side wall made of carbon substrate, a heat insulating substrate is interposed at the boundary between the cathode at the bottom and the side wall so as to prevent heat transfer from the bottom to the side wall. The stable solid batii is formed on the inner side wall of the electrolytic cell whereby the heat radiation from the electrolytic cell can be reduced and the heat energy can be saved.

5 Claims, 13 Drawing Figures

FIG. 1
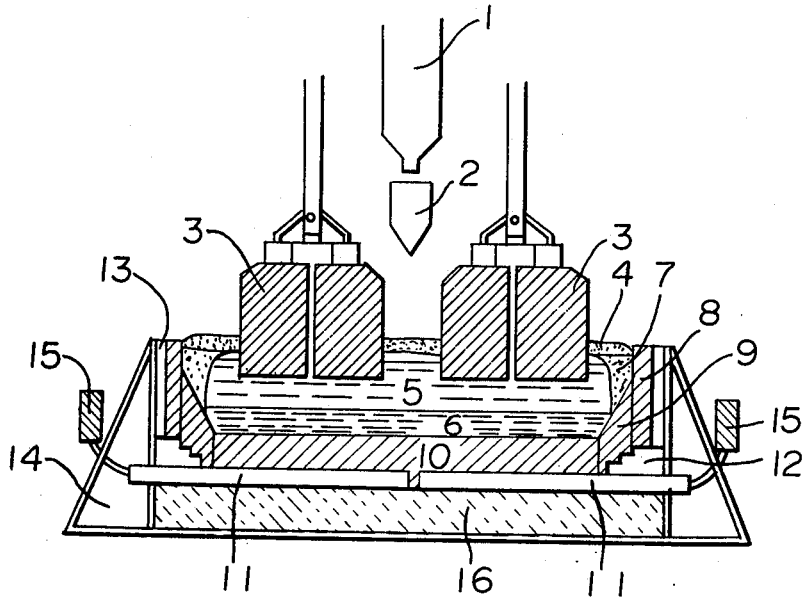
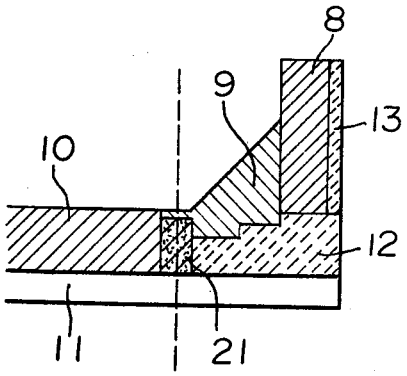
FIG. 2(a)
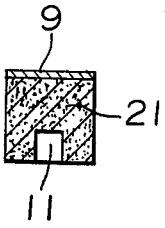
FIG. 2(b)

ELECTROLYTIC ALUMINA REDUCTION CELL WITH HEAT RADIATION REDUCING MEANS

BACKGROUND OF THE INVENTION

1. Field of the Invention

The present invention relates to the method of reducing heat radiation from the electrolytic alumina reduction cell. More particularly, it relates to a method of preventing the heat transfer from the bottom cathode of carbon blocks to the side wall made of carbon substrate by interposing the heat insulating substrate on the side surface of the cathode of the carbon blocks in the electrolytic alumina reduction cell.

2. Description of the Prior Arts

In order to prepare aluminum by the electrolysis of alumina, an electrolytic cell equipped with a carbon anode and a carbon cathode is used and 1 to 10% of alumina is melted in an electrolytic bath containing a main component of cryolite and current is fed to the bath at a current density of 0.5 to 1.0 A/cm$^2$ whereby the alumina is electrolyzed.

The alumina is reduced as aluminum metal and the resulting aluminum metal is collected at the bottom of the electrolytic bath and it is intermittently discharged from the electrolytic cell.

The current of 50,000 to 200,000 Amp. is passed between the anode and the cathode of the electrolytic alumina reduction cell. In the electrolytic bath, Joule's heat caused by the current is generated whereby the temperature of the bath is maintained at higher than the temperature for melting the bath preferably about 950° to 980° C.

When the alumina in the electrolytic bath is reduced to form aluminum and the concentration of alumina in the bath is reduced, suitable amount of alumina is usually fed from both sides or from the horizontal central axis in longitudinal direction of the electrolytic cell above the electrolytic bath.

When alumina is fed into the electrolytic bath, the temperature of the bath at the part is lowered by the alumina fed to the part. Sometimes, the bath is solidified to cause a solid bath in the electrolytic bath.

When the alumina is fed into the bath from both sides in the longitudinal direction of the electrolytic cell, the solid bath is formed to cover the whole inner wall of both sides in the longitudinal direction.

The solid bath protects the corrosion of the inner wall caused by the electrolytic bath at high temperature and it prevents the heat radiation from the inner part of the electrolytic cell.

However, in said case, the alumina is not fed to both sides in the short direction of the electrolytic cell, whereby the solid bath is scarcely formed on the inner wall at the both sides in the short direction. Accordingly, the inner wall is corroded by the electrolytic bath and a large quantity of heat is radiated from the inner part of the electrolytic cell through the parts out of the cell.

When the alumina is fed above the central axis in the longitudinal direction of the electrolytic cell, the solid bath is not substantially formed on the inner wall at the both sides in the longitudinal direction as well as the inner wall at the both sides in the short direction. Accordingly, the corrosion of the inner side wall caused by the electrolytic bath is quite high and the heat radiation from the inner part of the electrolytic cell is remarkably large.

The inventors have studied on the method of forming the solid bath on whole of the inner side wall of the electrolytic cell in order to protect the inner side wall from the corrosion caused by the electrolytic bath and to prevent a large quantity of heat radiation from the cell. As the result, the present invention has been attained by finding the fact that suitable solid bath can be formed on the inner side wall of the electrolytic cell by interposing a heat insulating substrate at the specific position of the cathode at the bottom of the electrolytic cell.

SUMMARY OF THE INVENTION

It is an object of the present invention to provide a method of reducing a heat radiation from an electrolytic alumina reduction cell.

It is another object of the present invention to provide a method of protecting an inner side wall of an electrolytic alumina reduction cell.

It is the other object of the present invention to provide a method of reducing a heat radiation from an electrolytic alumina reduction cell and protecting an inner side wall by forming a solid bath on the inner side wall of the electrolytic cell having a bottom cathode of carbon blocks and a side wall made of carbon substrate.

The foregoing and the other objects of the present invention have been attained by interposing a heat insulating substrate at the boundary between the cathode at the bottom and the side wall in the electrolytic alumina reduction cell.

BRIEF DESCRIPTION OF THE DRAWINGS

FIG. 1 is a vertical sectional side view of a conventional prebake type electrolytic alumina reduction cell in short direction;

FIGS. 2(*a*) to 5(*a*) are respectively vertical sectional side views of the bottoms of the electrolytic cells;

FIGS. 2(*b*) to 5(*b*) are respectively vertical sectional side views taken along the dotted line in FIGS. 2(*a*) to 5(*a*);

DETAILED DESCRIPTION OF THE PREFERRED EMBODIMENTS

Figure 3A:
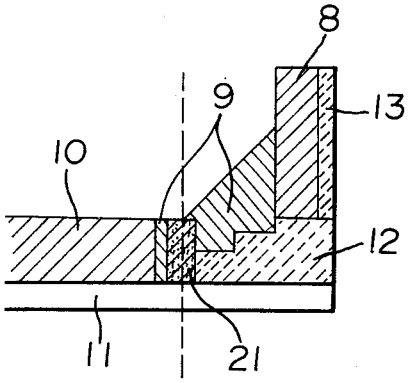

FIG. 1 shows a conventional prebake type electrolytic alumina reduction cell, wherein the reference numeral 1 designates a hopper for feeding alumina; 2 designates a pickel for breaking alumina crust; 3 designates a baked carbon anode; 4 designates alumina; 5 designates an electrolytic bath; 6 designates aluminum metal; 7 designates a solid bath; 8 designates a side carbon block; 9 designates a side cathode of lining carbon substrate; 10 designates a bottom cathode of carbon blocks; 11 designates a conductive rod; 12, 13 and 16 respectively designate refractory heat insulators; 14 designates the outer wall (casing) of cathode cell and 15 designates a cathode bus-bar.

As shown in FIG. 1, Joule's heat caused by the electrolytic current is mostly generated in the electrolytic bath 5 in the conventional electrolytic alumina reduction cell. The electrolytic bath 5 and the aluminum metal 6 are flowed in the electrolytic cell whereby the temperature in the electrolytic bath 5 is substantially uniform.

The Joule's heat generated in the electrolytic bath 5 is partially transferred to a baked carbon anode 3 and also is partially transferred through a solid bath 7, and both of the solid bath 7 and a side cathode of lining carbon substrate 9 to side carbon blocks 8, and also is partially transferred through an aluminum metal layer 6 to the bottom cathode of carbon blocks 10.

In the cathode of bottom carbon blocks 10, the Joule's heat is generated by the electrolytic current. The Joule's heat generated in the inner part of the carbon blocks 10 and the heat which is generated in the electrolytic bath 5 and is transferred through the aluminum metal layer to the inner part of the carbon blocks are partially transferred through the refractory heat insulator 16 at the bottom and are also partially transferred through the side of the bottom cathode of carbon blocks 10 to the side cathode of lining carbon substrate 9 and the side carbon blocks 8.

The side cathode of lining carbon substrate 9 and the side carbon blocks 8 are made of carbon substrate and have relatively high heat conductivity whereby the quantity of heat transferred from the bottom cathode of carbon blocks 10 to the side cathode of lining carbon substrate 9 and the side carbon blocks 8 is remarkably large.

Accordingly, the difference between the temperature of the electrolytic bath 5 and the temperature of both of the side cathode of lining carbon substrate 9 and the side carbon blocks 8 is small whereby the solid bath is not easily formed on the inner side wall in the electrolytic cell.

In accordance with the present invention, the heat transfer from the bottom cathode of carbon blocks 10 to the side cathode of lining carbon substrate 9 is prevented by the heat insulating substrate interposed at the boundary between the bottom cathode of carbon blocks 10 and the side cathode of lining carbon substrate 9 which is the side wall made of carbon substrate. As the results, the difference between the temperature of the electrolytic bath 5 and the temperature of both of the lining carbon substrate 9 and the carbon blocks 8 is large so as to form stable solid bath on the inner side wall in the electrolytic cell.

The amount of the solid bath is dependent upon the coefficient of blocking of heat transfer from the bottom cathode of carbon blocks to the side cathode of lining carbon substrate. When the coefficient of blocking of heat transfer is high, the amount of solid bath is large.

The heat insulating substrate used in the method of the present invention should be heat-resistant and have low heat conductivity.

Suitable heat insulating substrates include high alumina refractory brick, titanium-boride type brick, boron-nitride type brick, silicon-carbide type brick etc. It is optimum to use high alumina refractory brick because the purity of aluminum metal is not decreased even though the high alumina refractory brick is partially melted into the electrolytic bath by corroding it by the electrolytic bath.

When the heat insulating substrate is made of a material which may be corroded by the electrolytic bath, it is preferable to cover the heat insulating substrate with carbon substrate so as to prevent direct contact of the electrolytic bath with the heat insulating substrate as shown in FIG. 2.

In order to increase the coefficient of heat insulating, the heat insulating substrate is disposed to the height of at least 80% especially at least 85% to the height of the bottom cathode of carbon blocks.

Figure 3B:
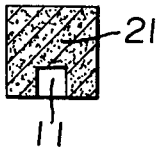
Figure 4A:
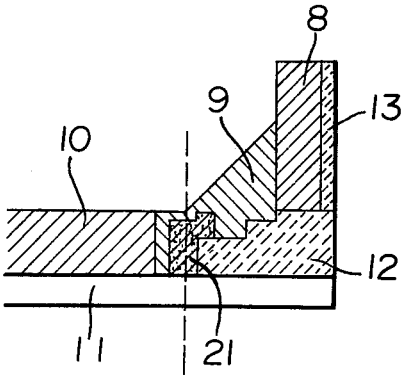
Figure 4B:
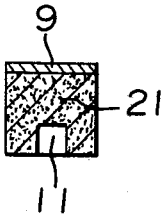
Figure 5A:
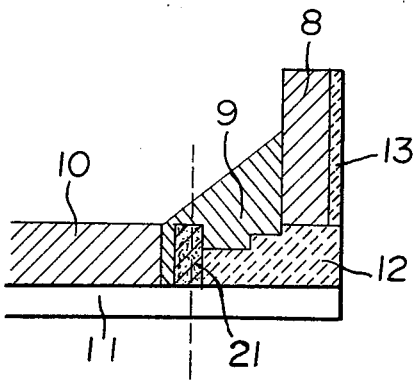
Figure 5B:
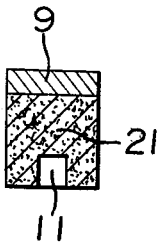

The heat insulating substrate is preferably disposed at the side of the bottom cathode of carbon blocks so as to contact with it as shown in FIG. 2. However, when the electrolytic bath is immersed through the gap between the bottom cathode of carbon blocks and the heat insulating substrate to corrode the conductive rod, it is preferable to interpose the carbon substrate having a thickness of about 1 to 12 cm between the bottom cathode of carbon blocks and the heat insulating substrate as shown in FIGS. 3, 4 and 5.

The thickness of the heat insulating substrate is dependent upon the size of the electrolytic alumina reduction cell, the quantity of current and the kind of the heat insulating substrate. In the electrolytic cell for preparing aluminum at a rate of 700 to 1100 kg/day with a current of 100,000 to 150,000 Amp., the thickness of the heat insulating substrate is usually 10 to 50 cm, when the heat insulating substrate is covered by carbon substrate as shown in FIGS. 2, 4 and 5. The thickness can be thinner when the heat insulating substrate is not covered by carbon substrate (the height of the heat insulating substrate is the same as that of the bottom cathode of carbon blocks).

The heat insulating substrate can be interposed at whole or part of the boundary between the bottom cathode of carbon blocks and the side cathode of lining carbon substrate. The thickness of the heat insulating substrate can be uneven.

For example, in the electrolytic cell for feeding alumina by falling down alumina on the surface of the electrolytic bath under the hopper 1 for feeding alumina through the hopper 1 disposed above the horizontal central axis of the electrolytic cell in the longitudinal direction as shown in FIG. 1, the alumina is not fed from the side part of the electrolytic cell whereby the solid bath is not substantially formed on the inner side wall.

Accordingly, in this type electrolytic cell, the heat insulating substrate is interposed at whole of the boundary between the bottom cathode of carbon blocks and the cathode of lining carbon substrate so as to form the solid bath at whole of the inner side wall.

On the other hand, in the electrolytic cell for feeding alumina from both sides of the electrolytic cell in the longitudinal direction, the solid bath is not substantially formed on the inner side wall in the short direction of the electrolytic cell, however the solid bath is formed on the inner side wall in the longitudinal direction of the electrolytic cell. Accordingly, the heat insulating substrate is interposed only on the boundary between the bottom cathode of carbon blocks and the side cathode of lining carbon substrate in the short direction of the electrolytic cell.

In this case, when the formation of the solid bath on the inner side wall in the longitudinal direction is not enough, it is preferable to interpose relatively thin heat insulating substrate at the boundary between the bottom cathode of carbon blocks and the side cathode of lining carbon substrate in the longitudinal direction of the electrolytic cell.

The present invention will be further illustrated in detail.

Figure 6:
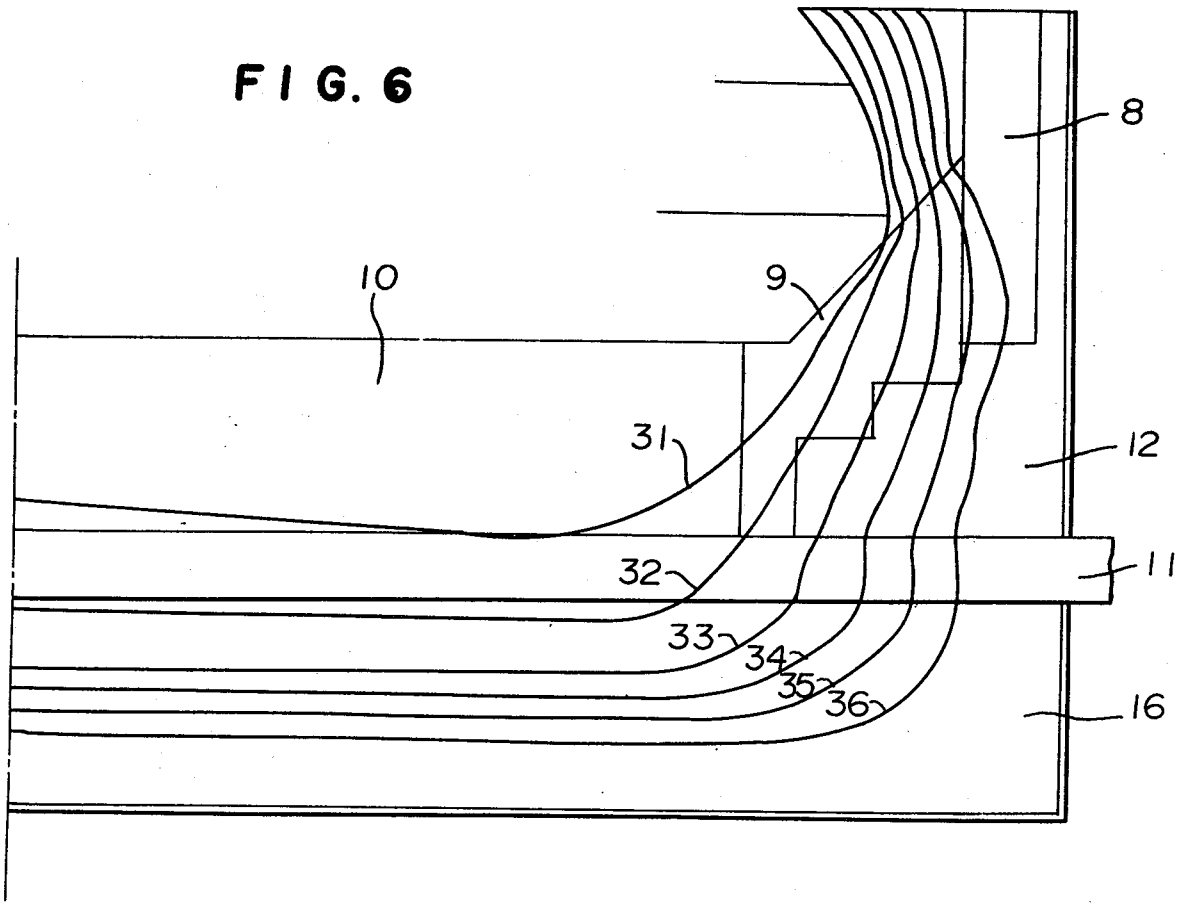
FIG. 6 is a vertical sectional view of the conventional electrolytic cell for showing the heat distribution.

The embodiment of FIG. 6 has the same structure of the embodiment of FIG. 1 and is a sectional side view of the electrolytic alumina reduction cell in the short direction in a current of 130,000 Amp., wherein isotherms are shown in the range of 500° to 900° C.

Figure 7:
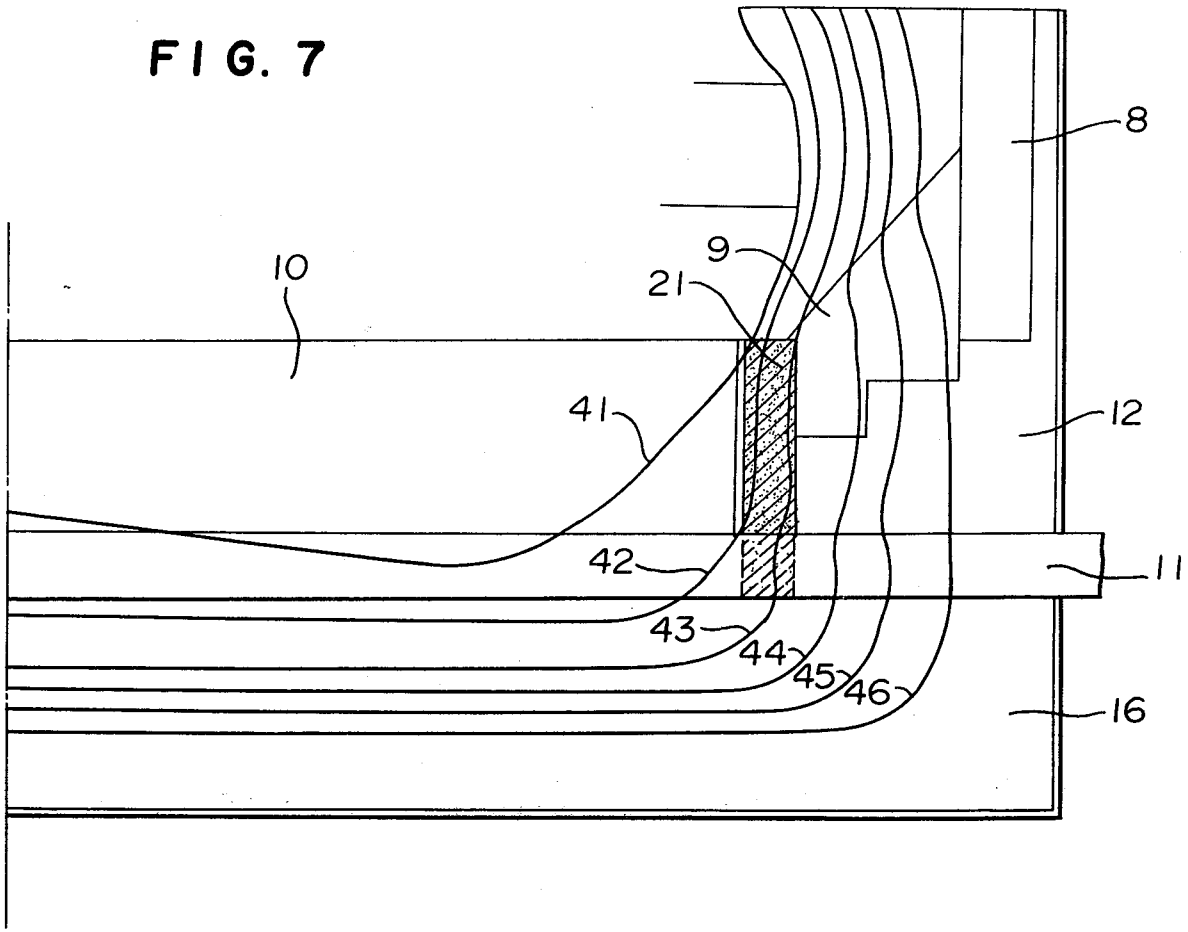
FIG. 7 is a vertical sectional view of the electrolytic cell of the present invention for showing the heat distribution.

FIG. 7 is a sectional side view of the electrolytic cell in the short direction wherein the heat insulating substrate (high alumina brick; thickness of 65 mm) is interposed at the boundary between the bottom cathode of carbon blocks and the side cathode of lining carbon substrate in the electrolytic cell and isotherms are shown in the range of 500° to 900° C. The isotherms in FIGS. 6 and 7 are obtained by calculations with the following constants.

| | | |
|---|---|---|
| Specific electric resistance (Ω · cm) | | |
| Bottom cathode of carbon blocks | $3.6 \times 10^{-6}$ | (900° C) |
| Side cathode of lining carbon substrate | $2.5 \times 10^{-3}$ | (900° C) |
| Cathode conductive rod | $4.1 \times 10^{-5}$ | (600° C) |
| Thermal conductivity (Watt/cm · deg) | | |
| Bottom cathode of carbon blocks<br>Side cathode of lining carbon substrate | $2.0 \times 10^{-1}$ | (900° C) |
| Side carbon block | $5.0 \times 10^{-2}$ | (500° C) |
| Cathode conductive rod | $4.5 \times 10^{-1}$ | (600° C) |
| Refractory heat insulating substrate<br>Side wall refractory heat insulating substrate | $8.0 \times 10^{-3}$ | (500° C) |
| Solid bath | $1.1 \times 10^{-2}$ | (800° C) |
| Heat transfer coefficient (Watt/cm$^2$ · deg) | | |
| Boundary surface between electrolytic bath and solid bath | $2 \times 10^{-2}$ | |
| Boundary surface between metal and solid bath | $4 \times 10^{-2}$ | |

In FIGS. 6 and 7, the reference numerals are the same with those of FIG. 1 and FIG. 2 and the reference numerals 31 and 41; 32 and 42; 33 and 43; 34 and 44; 35 and 45; and 36 and 46 are respectively isotherms at 950° C., 900° C., 800° C., 700° C., 600° C. and 500° C.

When FIG. 6 is compared with FIG. 7, it is clearly understood that the isotherms at 950° C. are approched to the central part in the electrolytic cell by interposing the heat insulating substrate between the bottom cathode of carbon blocks and the side cathode of lining carbon substrate. Accordingly, it is clear that the temperature for forming the solid bath in the electrolytic cell, that is the solidification temperature of the electrolytic bath is about 950° C. whereby the solid bath is effectively formed on the inner side wall of the electrolytic cell by interposing the heat insulating substrate at the bottom of the electrolytic cell.

As it is described in detail, in accordance with the method of the present invention, the solid bath is formed on the inner side wall of the electrolytic alumina reduction cell and the heat radiation from the electrolytic cell is decreased to easily save heat energy.

The present invention will be illustrated in detail by certain examples.

EXAMPLE 1

Figure 8:
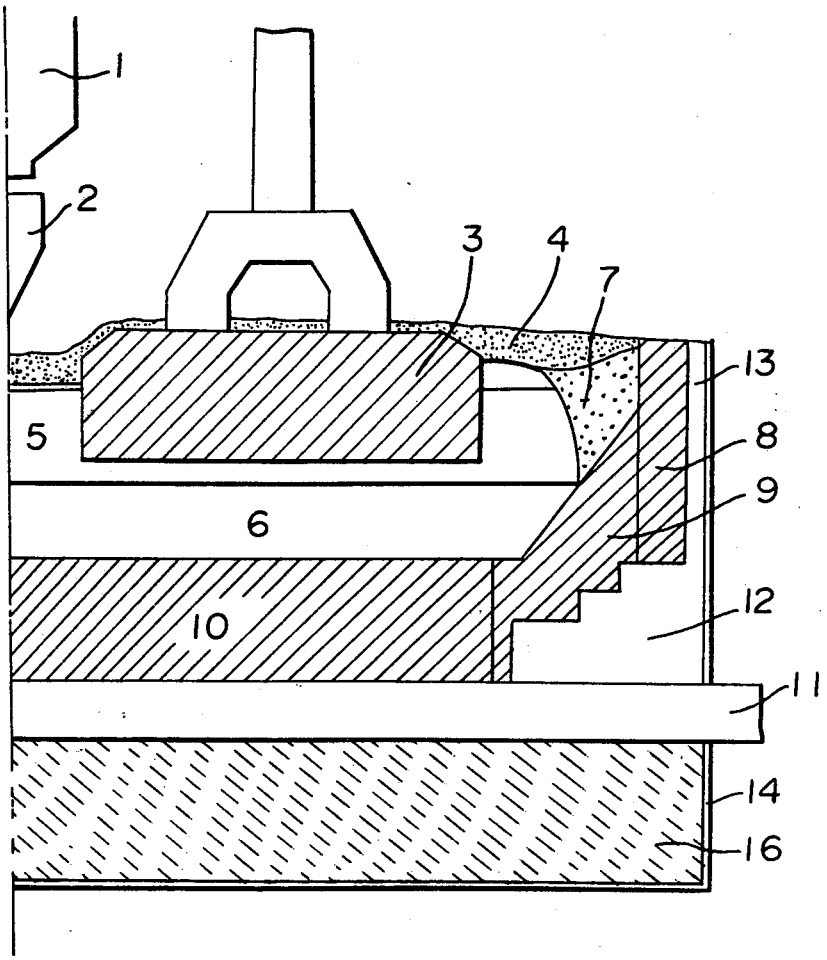
FIG. 8 is a vertical sectional view of the conventional electrolytic cell in the short direction.

An electrolytic alumina reduction cell shown in FIG. 8 was operated at a current of 150,000 Amp. and a cell voltage of 3.92 Volt. under feeding alumina from the upper part on the horizontal central axis in the longitudinal direction of the electrolytic cell. The solid bath 7 was not substantially formed in the aluminum metal 6.

Figure 9:
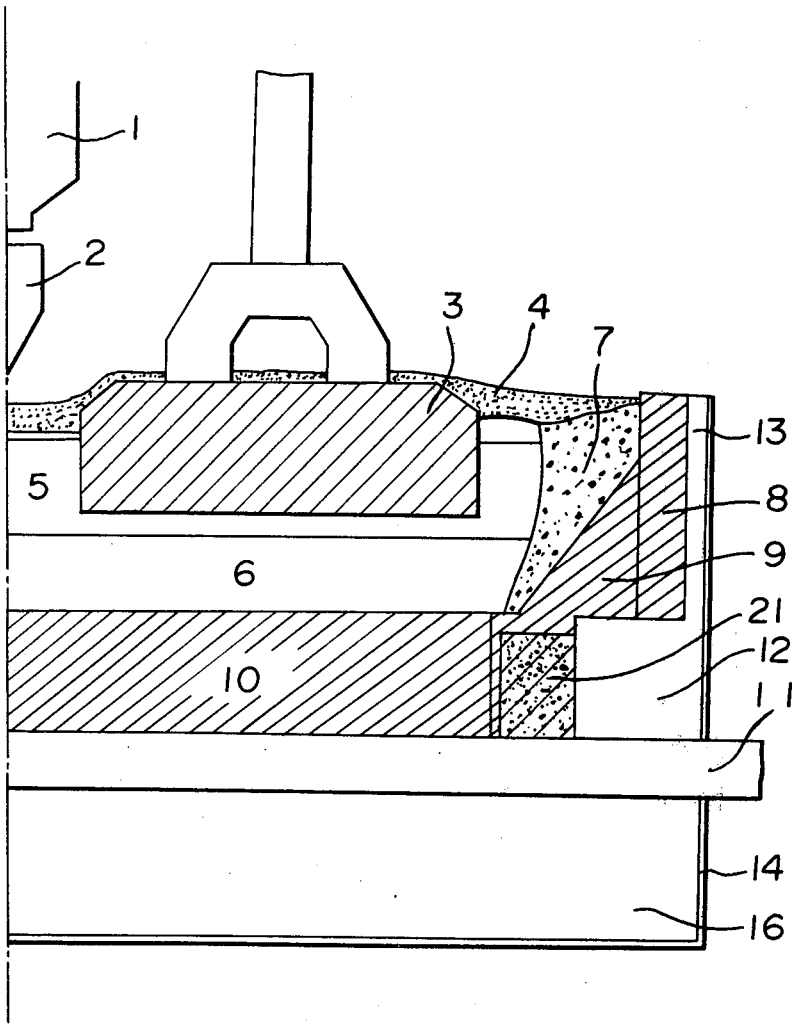
FIG. 9 is a vertical sectional view of the electrolytic cell of the present invention in the short direction.

A heat insulating substrate 21 (high alumina refractory bricks containing more than 90% of $Al_2O_3$ and having thickness of 20 cm) was interposed at the boundary between the bottom cathode of carbon blocks 10 and the side cathode of lining carbon substrate 9 in the electrolytic alumina reduction cell as shown in FIG. 9. The stable solid bath 7 was formed in the aluminum metal layer 6. The electrolytic cell could be operated at a current of 150,000 Amp. and a cell voltage of 3.82 Volt. which was 0.1 V lower than that of the reference shown in FIG. 8. As the result, about 300 to 350 KWH of electric energy could be saved for the production of 1 ton of aluminum.

What is claimed is:

1. In an alumina reduction cell having side walls and a bottom, arranged for containing a mass of electrolyte, and having one or more anodes each presenting a surface through which current flows, a bottom cathode formed of carbon blocks and presenting a surface through which current flows, said side walls being formed of a carbon substrate, the improvement comprising:

A body of heat insulating material being interposed at the boundary between said bottom cathode and said side walls sufficient to substantially diminish heat transfer from said bottom cathode to said side walls, wherein said heat insulating material reaches from the bottom of said boundary to at least 80% of the height of said bottom cathode.

2. The alumina reduction cell according to claim 1 wherein said heat insulating material is formed by at least one of high alumina refractory bricks, titanium-boride type bricks, boron-nitride type bricks and silicon-carbide type bricks.

3. The alumina reduction cell according to claim 1 having means wherein alumina is fed to the central part of said cell, and wherein said heat insulating material is interposed at the whole of the boundary between said bottom cathode and said side wall.

4. The alumina reduction cell according to claim 1 having means whereby alumina is fed from both sides in the longitudinal direction of said cell, and wherein said heat insulating material is interposed only at the boundary between said bottom cathode and said side wall in the short direction of said cell.

5. The alumina reduction cell according to claim 1 having means whereby alumina is fed from both sides in the longitudinal direction of said cell, and wherein a thin body of said heat insulating material is interposed at the boundary between said bottom cathode and said side wall in the longitudinal direction of said cell and a thick body of said heat insulating material is interposed at the boundary between said bottom cathode and said side wall in the short direction of said cell.

* * * * *